US011447728B2

(12) United States Patent
Cho et al.

(10) Patent No.: US 11,447,728 B2
(45) Date of Patent: Sep. 20, 2022

(54) LAUNDRY SHEET

(71) Applicant: LG HOUSEHOLD & HEALTH CARE LTD., Seoul (KR)

(72) Inventors: Min-Seok Cho, Daejeon (KR); Kyung-On Cha, Daejeon (KR); Sang-Woon Kwak, Daejeon (KR); Mun-Seong Jo, Seoul (KR); Jae-Hyun Kim, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 0 days.

(21) Appl. No.: 16/645,427

(22) PCT Filed: Sep. 7, 2018

(86) PCT No.: PCT/KR2018/010514
§ 371 (c)(1),
(2) Date: Mar. 6, 2020

(87) PCT Pub. No.: WO2019/050341
PCT Pub. Date: Mar. 14, 2019

(65) Prior Publication Data

US 2020/0277555 A1 Sep. 3, 2020

(30) Foreign Application Priority Data

Sep. 8, 2017 (KR) ..... 10-2017-0114878

(51) Int. Cl.

| | |
|---|---|
| ***C11D 17/06*** | (2006.01) |
| ***C11D 1/12*** | (2006.01) |
| ***C11D 3/10*** | (2006.01) |
| ***C11D 3/37*** | (2006.01) |
| ***C11D 1/00*** | (2006.01) |
| ***C11D 17/04*** | (2006.01) |

(52) U.S. Cl.
CPC ..... *C11D 17/06* (2013.01); *C11D 1/002* (2013.01); *C11D 3/3753* (2013.01); *C11D 17/044* (2013.01)

(58) Field of Classification Search
None
See application file for complete search history.

(56) References Cited

U.S. PATENT DOCUMENTS

| | | | | |
|---|---|---|---|---|
| 6,699,826 | B1 * | 3/2004 | Saijo | C11D 1/62 510/296 |
| 2007/0269651 | A1 * | 11/2007 | Denome | A61Q 13/00 428/327 |
| 2009/0156454 | A1 | 6/2009 | Schmiedel et al. | |
| 2011/0028374 | A1 | 2/2011 | Fossum et al. | |
| 2011/0136719 | A1 * | 6/2011 | Jalbert | C11D 3/3753 510/298 |
| 2018/0223230 | A1 * | 8/2018 | Tan | C11D 3/3707 |
| 2019/0010431 | A1 | 1/2019 | Cho et al. | |
| 2019/0194584 | A1 * | 6/2019 | Astete Boettcher | C11D 1/00 |
| 2020/0010784 | A1 | 1/2020 | Cho et al. | |

FOREIGN PATENT DOCUMENTS

| | | | |
|---|---|---|---|
| CN | 106635572 | A | 5/2017 |
| EP | 1 048 722 | A1 | 11/2000 |
| JP | 8-3848 | A | 1/1996 |
| JP | 10-8098 | A | 1/1998 |
| JP | 11-124600 | A | 5/1999 |
| JP | 2001-294899 | A | 10/2001 |
| JP | 2002-241798 | A | 8/2002 |
| JP | 2005-538202 | A | 12/2005 |
| JP | 2009-534493 | A | 9/2009 |
| JP | 2011-510065 | A | 3/2011 |
| JP | 2012-501372 | A | 1/2012 |
| JP | 2012-511045 | A | 5/2012 |
| JP | 2013-536270 | A | 9/2013 |
| JP | 2014-510190 | A | 4/2014 |
| JP | 2015-83591 | A | 4/2015 |
| JP | 2016-168745 | A | 9/2016 |
| KR | 10-2012-0021449 | A | 3/2012 |
| KR | 1146292 | B1 * | 5/2012 |
| KR | 10-2012-0127175 | A | 11/2012 |
| KR | 20120127174 | A * | 11/2012 |
| KR | 101358923 | B1 * | 2/2014 |
| KR | 10-1411559 | B1 | 6/2014 |
| KR | 10-2017-0068579 | A | 6/2017 |
| KR | 10-2017-0072824 | A | 6/2017 |
| KR | 10-2017-0096989 | A | 8/2017 |
| WO | WO 2010/025092 | A2 | 3/2010 |
| WO | WO 2010/077627 | A2 | 7/2010 |
| WO | WO 2016/058872 | A1 * | 4/2016 |

OTHER PUBLICATIONS

Hdidar et al., "Effect of hydrolysis degree and mass molecular weight on the structure and properties of PVA films," Ionics, Kiel, DE, vol. 23, No. 11, 2017 (published online Apr. 20, 2017), pp. 3125-3135, XP036347599, ISSN: 0947-7047, DOI: 10.1007/S1 1581-01 7-2103-0.

* cited by examiner

*Primary Examiner* — Lorna M Douyon
(74) *Attorney, Agent, or Firm* — Birch, Stewart, Kolasch & Birch, LLP

(57) ABSTRACT

The present invention provides a laundry sheet in which at least one laundry component is distributed inside a matrix formed from a water-soluble polymer, which is a polyvinyl alcohol or a polyvinyl alcohol-based polymer, and the laundry sheet has (i) a foamability of 0.5-0.9 (g/cm$^3$) or (ii) a drape stiffness of 3.5-7.5 cm.

2 Claims, No Drawings

LAUNDRY SHEET

CROSS REFERENCE TO RELATED APPLICATIONS

This application is the National Phase of PCT International Application No. PCT/KR2018/010514, filed on Sep. 7, 2018, which claims priority under 35 U.S.C. 119(a) to Patent Application No. 10-2017-0114878, filed in the Republic of Korea on Sep. 8, 2017, all of which are hereby expressly incorporated by reference into the present application.

TECHNICAL FIELD

The present disclosure relates to a laundry sheet. More particularly, the present disclosure relates to a laundry sheet that can be formulated with ease.

BACKGROUND ART

Currently, polymer films have been used widely for personal care products, such as medicines and cosmetics, and household items, such as daily supplies, as well as in the industrial fields, such as fine chemicals and electronic materials. Particular examples of application of a polymer film to medicines or cosmetics include poultice sheets or adhesive skin application sheets including a drug medicine stacked together with a water-insoluble polymer film on a substrate, wherein the polymer film forms a matrix and shows controlled-release property. In addition, polymer films in daily supplies have been used widely as packaging materials for packing specific materials and active ingredients divisionally to assist convenience in use. For example, polymer films have been used as materials for divisional packaging of a detergent composition, such as a powdery detergent and liquid detergent. In the related field of work, water-soluble polyvinyl alcohol films, gelatin films, starch films and cellulose films have been used as standard usage unit bags in order to prevent flying of powdery detergents, to induce adequate usage and to protect water quality.

In addition, technology of divisional packaging using water-soluble polymer films is known. However, when storing or transporting the products packaged divisionally in this manner, the contents may be leaked due to a failure in sealing and the active ingredients may soak out toward the film surface, resulting in degradation of storage stability of the products. Further, in the case of water-soluble films used as packaging materials, they are designed to have stability against moisture in the air and durability against the contents. However, for these reasons, such films require a significantly long time for dissolution at low temperature and cannot be dissolved completely to leave film residue.

Additionally, there is a laundry sheet including a laundry detergent ingredient and laundry softener ingredient distributed and solidified in a composition for forming a water-soluble polymer film. However, in this case, the laundry detergent ingredient and laundry softener ingredient form a complex, and thus cannot realize the performance of each ingredient effectively.

Meanwhile, there is a water-soluble laundry sheet including a detergent ingredient dispersed in a polymer matrix formed from a water-soluble film and providing a cleaning effect while the detergent ingredient is dissolved in water. Such a water-soluble sheet is convenient in use but still has several problems. For example, during the manufacture of the sheet, the water-soluble laundry sheet may be smashed when it is too hard. In addition, it is difficult to cut the laundry sheet into a desired size and to transport it, when it is too soft. In addition, when the sheet is smashed with ease during the distribution and use thereof, there is a problem related with commercial value.

DISCLOSURE

Technical Problem

The present disclosure is designed to solve the problems of the related art occurring when manufacturing laundry sheets.

The present disclosure is directed to solving the problems of the water-soluble laundry sheet that it may be smashed, when it is too hard, and it is difficult to cut the laundry sheet into a desired size and to transport it, when it is too soft.

The present disclosure is directed to providing a laundry sheet which is not smashed with ease and allows easy cutting.

The present disclosure is directed to providing various parameters of a preferred laundry sheet.

Technical Solution

In one aspect of the present disclosure, there is provided a laundry sheet, preferably a laundry sheet including a water-soluble polymer.

The laundry sheet according to the present disclosure is a laundry sheet made of a water-soluble polymer.

The laundry sheet has a sheet-like shape in the absence of water, and releases the ingredients for washing present inside and/or outside of the polymer matrix of the sheet to carry out washing, while it is disintegrated in the presence of water.

Preferably, the laundry sheet may use polyvinyl alcohol or a polyvinyl alcohol-based polymer (referred to as polyvinyl alcohol hereinafter) as a water-soluble polymer.

According to an embodiment of the present disclosure, there is provided a laundry sheet including at least one ingredient for laundry distributed in a water-soluble polymer matrix, wherein the laundry sheet may have (i) a foamability of 0.5-0.9 ($g/cm^3$) or (ii) a drape stiffness of 3.5-7.5 cm.

Particularly, the inventors of the present disclosure have found that when the laundry sheet has the above-mentioned characteristics, it is not smashed with ease and allows easy cutting.

Preferably, the laundry sheet may have a foamability ($g/cm^3$) of 0.5-0.9, more preferably 0.6-0.8. When the foamability is not within the above-defined range, the sheet may be prepared with ease. However, the sheet is not dissolved well in water and cannot be torn with ease to a desired amount, or is dissolved well in water but is smashed easily during the manufacture.

Preferably, the laundry sheet may have a drape stiffness of 3.5-7.5 cm, more preferably 4.5-6.5 cm. When the drape stiffness is not within the above-defined range, the sheet may be prepared with ease. However, the sheet is not dissolved well in water and cannot be torn with ease to a desired amount, or is dissolved well in water but is smashed easily during the manufacture.

According to the present disclosure, foamability is calculated as follows.

Foamability is expressed by the content of foam contained in the laundry sheet per unit volume. Herein, foamability is expressed in the unit of $g/cm^3$.

Foamability is calculated according to the following formula after measuring the net density, i.e. the content of foam per unit volume of the sheet:

$$\text{Foamability} = 1 - \textit{Net density} \qquad \text{[Formula]}$$

Drape stiffness is determined according to the Cantilever method by pushing out a specimen having a size of 2.5 cm×15 cm until it is in contact with a 41.5° tilted surface and measuring the length of the specimen based on ISO 9073-7, ASTM D-5732.

Drape stiffness is derived according to the following formula.

$$C=D/2, G=C^3 \times W$$

wherein, C=drape stiffness

D: length (cm) of specimen sagging on the stand tilted surface

G: flex stiffness

W: weight of sample (g/cm$^2$)

The inventors of the present disclosure have found that when the laundry sheet has the above-defined drape stiffness and foamability, the drape stiffness and foamability affect the solubility of the sheet. In addition, we have found for the first time that the foamability and drape stiffness of the sheet affect how the users easily tear the sheet into a desired size for use.

According to an embodiment the present disclosure, the stiffness may be controlled by Tg, the molecular weight or saponification degree of the water-soluble polymer, foamability of the laundry sheet, additives or combinations thereof.

In addition, the inventors of the present disclosure have found that the characteristics of the water-soluble polymer itself may also affect the physical properties of the laundry sheet from another embodiment.

The water-soluble polymer used herein preferably includes polyvinyl alcohol or a polyvinyl alcohol-based polymer. The polyvinyl alcohol or polyvinyl alcohol-based polymer affects the solubility of the laundry sheet depending on its glass transition temperature, and allows the sheet to be torn and fabricated with ease.

As the water-soluble polymer contained in the laundry sheet according to the present disclosure, the polyvinyl alcohol has a glass transition temperature (Tg) of 56-75° C., preferably 62-73° C.

Glass transition temperature (Tg) means the temperature where polymer material molecules have activity and start to move.

The inventors of the present disclosure have found that polyvinyl alcohol having a glass transition temperature of 56-75° C. improves the solubility of the sheet, allows the sheet to be torn with ease, and prevents the sheet from being smashed easily.

The laundry sheet according to the present disclosure may be obtained by dissolving polyvinyl alcohol in an adequate amount of water to form a polyvinyl alcohol polymer solution, mixing the solution with other additives, such as a surfactant, forming the resultant product into a sheet having a predetermined thickness, and drying the sheet. In addition, the method for fabricating the laundry sheet according to the present disclosure is not limited to the above-mentioned method. For example, other additives, such as a surfactant, may be dissolved in water, before polyvinyl alcohol is dissolved in water.

The laundry sheet according to the present disclosure may be obtained by drying the water-soluble polymer solution in which the water-soluble polymer is dissolved, and the water-soluble polymer forms a matrix structure among the polymer molecules. The water-soluble polymer solution may include an ingredient for laundry. While the water-soluble polymer solution containing the ingredient for laundry dissolved therein is dried, the ingredient for laundry may be incorporated into the polymer matrix structure. During the drying, the ingredient for laundry may also be partially present outside of the matrix structure.

The ingredient for laundry may be exemplified by 'a detergent ingredient for laundry'.

The detergent ingredient for laundry may include currently used anionic surfactants, non-ionic surfactants, amphoteric surfactants or a mixture thereof.

The anionic surfactants may include carboxylate compounds, such as soap, higher alcohols, higher alkyl esters, sulfuric ester salt compounds prepared by sulfation of olefins, alkylbenzene sulfonates, sulfate compounds including lauryl sulfate salts, phosphate compounds prepared by phosphorylation of higher alcohols, or the like.

Particular examples of the anionic surfactants include, but are not limited to: lauryl benzenesulfonic acid, α-olefin sulfonate, sodium lauryl sulfate, sodium lauryl ethoxylated sulfate, secondary alkanesulfonate, methyl ester sulfonate, or the like. Such anionic surfactants may be used alone or in combination. Preferably, among the anionic surfactants, sodium lauryl sulfate may be used.

In addition, particular examples of the non-ionic surfactants include, but are not limited to: polyoxyalkylene alkyl phenyl ether, polyoxyalkylene alkyl ether, polyoxyethylene polyoxypropylene block polymer, polyethylene glycol fatty acid ester, polyoxyethylene sorbitan fatty acid ester, cocamidomonomethylamine, cocamidodimethyl amine, cocamidomonoethylamine, fatty acid alkanolamine, amine oxide, alkyl polyglucoside, methyl polyethylene alkyl ether, sugar ether, or the like. Such non-ionic surfactants may be used alone or in combination. Particularly, it is preferred to use polyoxyalkylene alkyl ether represented by the following Chemical Formula 1 or polyoxyalkylene alkyl phenyl ether represented by the following Chemical Formula 2.

$$C_m—H_{2m+1}—O—(CH_2CH_2O)_n—H \quad \text{[Chemical Formula 1]}$$

$$C_mH_{2m+1}C_6H_5—O—(CH_2CH_2O)_n—H \quad \text{[Chemical Formula 2]}$$

In Chemical Formula 1 and Chemical Formula 2, m is an integer of 5-21, and n is an integer of 1-20.

In addition, particular examples of the amphoteric surfactants include, but are not limited to: amine oxide, cocamidopropyl betaine, or the like. Such amphoteric surfactants may be used alone or in combination.

Additionally, the ingredient for laundry may be exemplified by 'a softener ingredient for laundry'.

According to the present disclosure, the softener ingredient for laundry includes a currently used fabric softener.

More particularly, the laundry sheet according to the present disclosure may include, as a fabric softener, a cationic surfactant based on a quaternary ammonium salt. For example, at least one ingredient selected from dialkyl dimethyl ammonium chloride represented by the following Chemical Formula 3, dialkyl imidazolinium salt represented by the following Chemical Formula 4, dialkylamido quaternary ammonium salt represented by the following Chemical Formula 5 and ester quat types may be used.

[Chemical Formula 3]

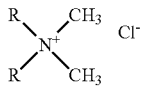

[Chemical Formula 4]

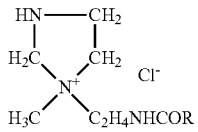

[Chemical Formula 5]

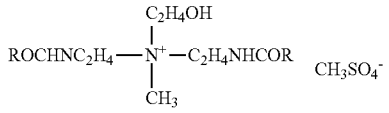

In Chemical Formula 3, Chemical formula 4 and Chemical Formula 5, each R is independently selected from the group consisting of C1-C30 linear or branched, saturated or unsaturated alkyl hydrocarbons.

In addition, the fabric softener ingredient may include a natural or synthetic cationic polymer. Particular examples of the cationic polymer include, but are not limited to: cationic guar, such as guar hydroxypropyltrimonium chloride, hydroxypropyl guar hydroxypropyltrimonium chloride, or the like, cellulose (Polyquaternium-10), Polyquaternium series, dimethyl diallyl ammonium chloride polymer, acrylamide-dimethyl diallyl ammonium copolymer, polyvinyl pyrrolidone (PVP)-dimethylaminoethyl methacrylate copolymer, acrylic acid-dimethyl diallyl ammonium chloride copolymer, acrylamide-dimethylaminoethyl methacrylate methyl chloride copolymer, trimethylaminoethyl methacrylate polymer, or the like. Such polymers may be used alone or in combination.

The laundry sheet according to the present disclosure may further include additives in order to improve washing capability or film formability without detracting from film forming property, storage stability and producibility of the sheet. Such additives may include a fluorescent whitening agent; enzyme (such as cellulase, protease, etc.); alkali builder (such as sodium hydroxide, sodium carbonate, sodium hydrogen carbonate, sodium metasilicate, sodium alkalisilicate, neutral sodium silicate, sodium tripolyphosphate, sodium pyrophosphate, sodium borate, zeolite (sodium aluminosilicate), sodium sesquicarbonate, MEA, TEA); disintegrating agent/disintegrating aid (such as starch, cellulose derivative, sodium chloride, citric acid, glycerin, propylene glycol); fabric softener (such as a cationic surfactant based on quaternary ammonium salt, silicone type fabric softener ingredient); bleaching agent (such as perborate, percarbonate, perphosphate, diacyl, tetracyl peroxide); dispersant/emulsifier (such as polyoxyalkylene alkyl phenyl ether, polyoxyalkylene alkyl ether, polyoxyethylene polyoxypropylene block polymer); sterilizing agent/disinfecting agent (such as sodium hypochlorite, hydrogen peroxide, iodine peroxide); fragrance; preservative; colorant; antibacterial agent; or the like.

The additives may be used in an amount of 0.1-30 wt % based on the total weight of the sheet after drying.

The laundry sheet according to the present disclosure may have a thickness of 1 μm-1 cm, preferably 5 μm-0.5 cm, and more preferably 50 μm-1 mm. When the laundry sheet has a thickness less than 1 μm after drying, it is not possible to take active ingredients sufficiently, the film has low strength, and it is difficult to obtain desired quality. When the laundry sheet has a thickness larger than 1 cm after drying, the sheet is dissolved too slowly, thereby causing degradation of washing quality.

The laundry sheet according to the present disclosure is completely dissolved when it is used together with clothes in a water barrel of a washing machine. Thus, there is no need for removing the laundry sheet after laundry.

The laundry sheet according to the present disclosure may be used in the form of two or more integrated layers including the sheet according to the present disclosure stacked with another sheet.

According to the present disclosure, the total content of polyvinyl alcohol may be 20-60 wt %, preferably 30-50 wt %, based on the total weight of the sheet after drying. Within the above-defined range, the laundry sheet according to the present disclosure realizes desired physical properties.

According to the present disclosure, as a PVA polymer, a polymer having a molecular weight of 10,000-100,000, preferably 20,000-50,000 may be used.

The total content of the surfactants contained in the laundry sheet according to the present disclosure may be 20-70 wt %, preferably 30-60 wt %, based on the total weight of the sheet after drying. Within the above-defined range, it is possible to fabricate the sheet with ease without any effect of the surfactants.

The laundry sheet according to the present disclosure may include, as a surfactant ingredient for providing a washing effect, C8-18 alkylsulfate alkali metal salt, preferably sodium lauryl sulfate. Preferably, the laundry sheet may include the main surfactant in an amount of 30-80 wt %, more preferably 40-75 wt %, and even more preferably 50-70 wt %, based on the total weight of the surfactants.

In another aspect of the present disclosure, there is also provided a laundry sheet obtained by using polyvinyl alcohol or polyvinyl alcohol-based copolymer and a surfactant as an active ingredient for laundry, characterized in that C8-18 alkyl sulfate alkali metal salt is used as a main surfactant, and a non-ionic surfactant such as polyoxyethylene alkyl ether, an anionic surfactant such as a surfactant having an ethylene oxide group in its structure, aromatic surfactant, or a non-aromatic surfactant free from ethylene oxide group is used as a supplementary surfactant.

Advantageous Effects

The present disclosure provides a laundry sheet having excellent solubility.

The present disclosure provides a laundry sheet which is not smashed with ease during its manufacture.

The laundry sheet according to the present disclosure can be torn or cut easily, and thus usage of the laundry sheet may be controlled with ease.

BEST MODE

Examples will be described more fully hereinafter so that the present disclosure can be understood with ease. The following examples may, however, be embodied in many different forms and should not be construed as limited to the exemplary embodiments set forth therein. Rather, these exemplary embodiments are provided so that the present disclosure will be thorough and complete, and will fully convey the scope of the present disclosure to those skilled in the art.

1. Foamability, Physical Properties and Cuttability of Water-Soluble Laundry Sheet (1) Manufacture of Sheet

TABLE 1

| Ex. | 01 | 02 | 03 | 04 | 05 | 06 | 07 | 08 |
|---|---|---|---|---|---|---|---|---|
| Foamability ($g/cm^3$) | 0.35 | 0.4 | 0.5 | 0.6 | 0.7 | 0.8 | 0.9 | 0.95 |
| Solubility | Poor | Insufficient | Satisfactory | Satisfactory | Excellent | Excellent | Excellent | Excellent |
| Physical properties | Δ | ○ | ○ | ○ | ○ | Δ | Δ | X |
| Cuttability | 1 | 1 | 2 | 2 | 3 | 3 | 3 | 2 |

Each of the sheets having a foamability as shown in Table 1 was fabricated. First, 200 g of PVA (saponification degree: 86.5%, average polymerization degree: 500) was introduced to 800 g of distilled water and dissolved therein at 80° C. for 4 hours to form 20 wt % PVA solution. Next, a surfactant (SLS, sodium lauryl sulfate), builder (sodium carbonate), fragrance, or the like were introduced to the PVA solution (40 wt % of PVA, 48 wt % of surfactant, 10 wt % of builder, 2 wt % of fragrance) and mixed therewith by using a mechanical stirrer so that they might be dissolved. Herein, rpm of the mechanical stirrer and agitation time were controlled to form a PVA solution having each foamability as shown in Table 1. Then, the PVA solution was loaded on a release film, controlled to a predetermined thickness by using a film applicator available from Elcometer Co., and dried in a drying oven at 105° C. for 10 minutes to obtain a PVA film sheet. The foamability was controlled by adjusting the air introduction amount in a foam controlling device and the rotation number of the stirrer.

(2) Evaluation of Physical Properties

A. Determination of Solubility

Solubility was determined as follows. Each sheet was cut into a size of 5 cm×5 cm and introduced to a 500 mL beaker. Next, 300 mL of purified water at 15° C. was introduced to the beaker and agitation was carried out at a rate of 300 rpm. The time required for complete disintegration and dissolution of the film was measured and evaluated in a 4-grade scale: excellent (within 3 minutes), satisfactory (3-5 minutes), insufficient (5-10 minutes), and poor (more than 10 minutes).

B. Calculation of Foamability

Foamability was expressed by the content of foam contained in the sheet per unit volume.

Foamability was calculated according to the following formula after measuring the net density, i.e. the content of foam per unit volume of the sheet:

$$\text{Foamability}=1-\textit{Net}\text{density} \qquad \text{[Formula]}$$

C. Evaluation of Physical Properties

Evaluation of physical properties: ○ (excellent), Δ (good), X (poor: easily broken or smashed)

D. Cuttability

Cuttability was evaluated by providing each sheet to 10 users and allowing them to evaluate how they easily tear the sheet to a desired size by using hands in a three-grade scale.

Functional test results: 1 (poor: not easily cut), 2 (insufficient: hardly cut into a desired size), 3 (good: easily cut into a desired size)

D. Results

After manufacturing the sheets as described above, in the case of the sheets having a foamability according to Ex. 01 and Ex. 02, they show a low solubility of 5 minutes or more and thus have low commercial value. In the case of the sheets having a foamability according to Ex. 03-Ex. 08, they show excellent solubility. However, when the foamability exceeds 0.9, like Ex. 08, the sheet product is easily broken undesirably.

When the sheet is fabricated to have a foamability of 0.5-0.9, it is possible to manufacture the sheet with ease and to provide the sheet with excellent solubility.

2. Determination of Drape Stiffness (1) Manufacture of Sheet

The laundry sheets according to the following Tables 2 and 3 were manufactured in the same manner as described above.

TABLE 2

| Ex. | 09 | 10 | 11 | 12 | 13 | 14 | 15 | 16 | 17 | 18 | 19 | 20 |
|---|---|---|---|---|---|---|---|---|---|---|---|---|
| Drape stiffness | 1.10 | 2.93 | 3.96 | 4.54 | 4.81 | 5.50 | 6.06 | 6.11 | 7.08 | 8.13 | 9.35 | 9.87 |
| Physical properties | X | X | Δ | Δ | ○ | ○ | ○ | ○ | Δ | X | X | X |
| Cuttability | 2 | 2 | 2 | 2 | 3 | 3 | 3 | 3 | 3 | 2 | 1 | 1 |

TABLE 3

| Ex. | 21 | 22 | 23 | 24 | 25 | 26 | 27 | 28 |
|---|---|---|---|---|---|---|---|---|
| Foamability ($g/cm^3$) | 0.35 | 0.4 | 0.5 | 0.6 | 0.7 | 0.8 | 0.9 | 0.95 |
| Drape stiffness | 8.35 | 7.92 | 6.98 | 6.11 | 5.38 | 4.12 | 3.35 | 2.37 |
| Physical properties | X | Δ | ○ | ○ | ○ | Δ | Δ | X |
| Cuttability | 1 | 2 | 2 | 3 | 3 | 3 | 3 | 2 |

(2) Physical Properties

A. Method for Determination of Drape Stiffness

Drape stiffness was derived according to the following formula.

$$C=D/2, G=C^3\times W$$

wherein, C: drape stiffness

D: length (cm) of specimen sagging on the stand tilted surface

G: flex stiffness

W: weight of sample ($g/cm^2$)

Drape stiffness was determined according to the Cantilever method (ISO 9073-7, ASTM D-5732) by pushing out a specimen having a size of 2.5 cm×15 cm until it is in contact with a 41.5° tilted surface and measuring the length of the specimen.

B. Evaluation of Physical Properties

Evaluation of physical properties: ○ (excellent), Δ (good), X (poor: easily broken or smashed)

C. Cuttability

Cuttability was evaluated by providing each sheet to 10 users and allowing them to evaluate how they easily tear the sheet to a desired size by using hands in a three-grade scale.

Functional test results: 1 (poor: not easily cut), 2 (insufficient: hardly cut into a desired size), 3 (good: easily cut into a desired size)

D. Results

The sheets of Ex. 11-Ex. 17 were not smashed easily during manufacture. Particularly, the sheets of Ex. 13-Ex. 16 was manufactured with ease and the resultant sheets are not smashed. Meanwhile, referring to Ex. 24 and Ex. 25, it can be seen that when satisfying both the foamability and drape stiffness according to the present disclosure, the sheet has excellent cuttability and physical properties.

3. Glass Transition Temperature and Physical Properties of Water-Soluble Polymer (1) Manufacture of Sheet

TABLE 4

| Ex. | 29 | 30 | 31 | 32 | 33 | 34 | 35 | 36 | 37 | 38 | 39 | 40 |
|---|---|---|---|---|---|---|---|---|---|---|---|---|
| Tg (° C.) | 48 | 52 | 56 | 60 | 63 | 65 | 68 | 70 | 75 | 78 | 82 | 85 |
| Physical properties | X | X | Δ | Δ | ○ | ○ | ○ | ○ | Δ | X | X | X |

Each of the sheets having a Tg as shown in Table 4 was manufactured. First, 200 g of each PVA (Ex. 29-Ex. 40) was introduced to 800 g of distilled water and dissolved therein at 80° C. for 4 hours to form 20 wt % PVA solution. Next, a surfactant (SLS, sodium lauryl sulfate), builder (sodium carbonate), fragrance, or the like were introduced to the PVA solution (40 wt % of PVA, 48 wt % of surfactant, 10 wt % of builder, 2 wt % of fragrance) and mixed therewith by using a mechanical stirrer so that they might be dissolved therein. Then, the PVA solution was loaded on a release film, controlled to a predetermined thickness by using a film applicator available from Elcometer Co., and dried in a drying oven at 105° C. for 10 minutes to obtain a PVA film sheet (thickness: 0.01 cm).

(2) Physical Properties

A. Determination of Tg

Tg was determined by using a heat flux DSC (differential scanning calorimeter) available from Mettler-Toledo Co. at a heating rate of 10° C./min.

B. Evaluation of Physical Properties

Results: ○ (excellent), Δ (good), X (poor: easily broken or smashed)

C. Results

The sheets using PVA having a Tg according to Ex. 29, Ex. 30, Ex. 38, Ex. 39 and Ex. 40 are broken or smashed easily. Thus, it is difficult to formulate those sheets and the sheets show low commercial value. When using PVA having a Tg according to Ex. 31-Ex. 37, it is relatively easy to formulate the sheets and the sheets have good quality.

INDUSTRIAL APPLICABILITY

The present disclosure provides a laundry sheet which is dissolved completely in water and is not required to be removed after laundry. The laundry sheet according to the present disclosure has excellent washing quality, is convenient to use, and allows the users to cut it easily as necessary for use.

What is claimed is:

1. A laundry sheet comprising at least one ingredient for laundry distributed in a water-soluble polymer matrix, wherein the water-soluble polymer is polyvinyl alcohol, and the polyvinyl alcohol has a glass transition temperature (Tg) of 62-73° C., and wherein the ingredient for laundry comprises a surfactant and a sodium carbonate builder, wherein the total content of polyvinyl alcohol is 30-50 wt % based on the total weight of the sheet after and wherein the total content of surfactant is 48-60 wt % based on the total weight of the sheet after drying and wherein the surfactant comprises a C8-18 alkyl sulfate alkali metal salt.

2. The laundry sheet according to claim 1, wherein the ingredient for laundry further comprises a fragrance.

* * * * *